United States Patent [19]

Taylor, Jr.

[11] Patent Number: 4,637,229

[45] Date of Patent: Jan. 20, 1987

[54] PNEUMATIC THREAD TENSIONING DEVICE

[76] Inventor: James W. Taylor, Jr., 5211 - 154th Ave. NE., Redmond, Wash. 98052

[21] Appl. No.: 700,452

[22] Filed: Feb. 11, 1985

[51] Int. Cl.[4] ..... D04B 15/44; D03D 47/34

[52] U.S. Cl. ..... 66/146; 112/DIG. 3; 139/450; 242/147 A

[58] Field of Search ..... 66/125 R, 140 S, 145 S, 66/146; 139/450; 242/147 A; 112/DIG. 3

[56] References Cited

U.S. PATENT DOCUMENTS

| | | | |
|---|---|---|---|
| 2,302,790 | 11/1942 | Modigliani | 242/147 AX |
| 3,014,356 | 12/1961 | Butler | 66/146 |
| 3,188,713 | 6/1965 | Dyer et al. | 28/1 |
| 3,376,901 | 4/1968 | Strake | 139/450 X |
| 4,119,253 | 10/1978 | Benson | 226/7 |
| 4,297,834 | 11/1981 | Franzen | 57/58.86 |

FOREIGN PATENT DOCUMENTS

| | | | |
|---|---|---|---|
| 613631 | 12/1960 | Italy | 66/125 R |
| 508074 | 7/1971 | Switzerland | 139/450 |
| 343868 | 2/1931 | United Kingdom | 66/146 |
| 1469534 | 4/1977 | United Kingdom . | |
| 267799 | 3/1972 | U.S.S.R. | 66/146 |

*Primary Examiner*—Wm. Carter Reynolds
*Attorney, Agent, or Firm*—Bruce A. Kaser

[57] ABSTRACT

A pneumatic tensioning device (10) maintains a desired tension in a thread (18) as it is fed from a spool to a knitting or fabric weaving machine. A first tubular member (40) has an inner passageway (42) extending the length of the tube (40) that permits thread advancement therethrough. A second tubular member (46) surrounds the first tubular member (40) so that the inner walls of the second member and the outer walls of the first member define an outer passageway (48). An airflow is directed through the outer passageway in a direction that is the same as the direction of thread advancement. An orifice (54) communicates the airflow from the outer passageway (48) into the inner passageway (42) in a manner so that the direction of the airflow is reversed. The airflow thus flows in a direction that is opposite to thread advancement, wherein such opposing airflow causes a certain amount of tension in the thread.

29 Claims, 12 Drawing Figures

PNEUMATIC THREAD TENSIONING DEVICE

TECHNICAL FIELD

This invention pertains to an apparatus and method for maintaining a desired tension in a thread as it is fed into a knitting or fabric weaving machine. More particularly, the invention pertains to a device that maintains thread tension as the thread advances through a passageway by directing an airflow through the passageway in a direction that opposes thread advancement.

BACKGROUND ART

It is important to control tension in a thread as it is being fed into a knitting or fabric weaving machine. Preferably, thread tension should remain constant during such feeding process. This is important because as is well-known in the art, nonuniform thread tension adversely affects the knit or weave of the fabric. A number of devices and method have been developed for controlling thread tension, and have been disclosed in the following United States Patents: U.S. Pat. No. 3,014,356 issued to Butler on Dec. 26, 1961; U.S. Pat. No. 3,188,713 issued to Dyer on June 15, 1965; U.S. Pat. No. 3,364,889 issued to Wiener on Jan. 23, 1968; U.S. Pat. No. 3,994,166 issued to Hermanns on Mar. 16, 1976; U.S. Pat. No. 4,119,253 issued to Benson on Oct. 10, 1978; and U.S. Pat. No. 4,297,834 issued to Franzen on Nov. 3, 1981.

The above-cited patents generally teach the use of an airflow to control the advancement of thread, or to control thread tension. Several of these patents, and specifically, Butler, Wiener, Hermanns and Benson teach using an airflow to control thread tension, wherein the thread is fed and advanced through a passageway and an airflow traveling through the passageway in an opposing direction causes tension in the thread. The present invention utilizes this general concept. These patents, however, introduce the airflow into the passageway in a manner that is different from the instant invention.

Referring now to FIG. 10, which schematically illustrates the teachings of several of the above patents, therein is shown a hollow cylindrical tube 1 that provides a passageway for thread advancement. The thread would advance through the tube 1 in the direction indicated by arrow 2. Air is fed from a chamber 3 by means of an orifice 4 into the tube 1. Air is fed into the chamber 3 from an air supply means, wherein the air is fed into the side of the chamber 3 from a tube 5. It is to be understood, of course, that FIG. 10 is merely a schematic drawing and is provided herein for the purpose of demonstrating at least some of the differences between the prior art and the present invention.

A problem with using an airflow to control thread tension in the manner shown in FIG. 10 is that by introducing an airflow from the side tube 5, a swirling airflow is generated in the chamber 3. Such swirling or turbulent airflow is then communicated onward into tube 1 in the manner shown by arrows 6. This places a twist on the thread as it travels through the tube 1. Another problem is that the amount of airflow from chamber 3 into the tube 1 is governed not by adjusting the orifice 4, but by adjusting the amount of airflow that is fed into the chamber 3 from the side tube 5.

Referring now to FIG. 11, therein is shown a schematic representation showing at least one difference between the present invention and the prior art. The present invention provides an airflow 7 that travels in substantially the same direction as the direction of thread advancement 2. The airflow 7 is reversed and directed by an orifice 8 into the inner passageway, formed by hollow tube 1, wherein the airflow then opposes the advancement of the thread. By supplying the airflow into the tube 1 in this manner, the airflow is introduced into the tube in a smooth and nonturbulent manner, wherein the airflow streamlines are parallel to the direction of thread advancement.

It should be appreciated that Franzen, U.S. Pat. No. 4,297,834, teaches a similar reversal of airflow as that which is shown in FIG. 11. There are, however, differences between Franzen and the present invention which make the present invention patentable over Franzen. One major difference is that in Franzen an airflow is directed downwardly along a passageway 21, wherein the airflow is not used to control tension in the thread. The airflow in the passageway 21 travels in the same direction as the thread advancement. In the instant invention, and in the other prior art references cited above, the airflow is used to oppose thread advancement. The airflow created in the passageway 21 of Franzen is created for the purpose of causing a vacuum that pulls a yarn braking body 7 downwardly. The Franzen device controls thread tension by utilizing a braking body 7 and a braking surface 4. Pulling the braking body 7 away from the braking surface 4 permits thread advancement. This is undesirable because the thread is constantly in sliding contact with a surface.

The present invention addresses the known problems associated with the prior art, and others.

DISCLOSURE OF THE INVENTION

The present invention provides a pneumatic tensioning apparatus for maintaining a desired tension in a thread, such as a thread of yarn or the like, as it is being fed to a knitting or fabric weaving machine. A first tubular member is provided having an inner passageway that extends the length of the member along an axis. The thread extends and travels through the passageway in a particular direction as it is fed from a spool to the knitting machine. A second tubular member surrounds the first member in a manner so that the inner walls of the second member and the outer walls of the first member define an outer passageway. The outer passageway is coaxial with the inner passageway. An airflow is supplied into the outer passageway in a direction that is substantially the same as the direction of thread feed travel in the inner passageway. An orifice communicates the airflow from the outer passageway into the inner passageway. During the process of such flow communication, the airflow is reversed so that it flows through the inner passageway in a direction that opposes the direction of thread feed travel. Such opposing flow causes a certain amount of tension to be maintained in the thread. The amount of the opposing airflow can be adjusted to likewise adjust thread feed tension.

Preferably, the first and second tubular members will each be in the form of cylindrical tubes. The second tube will surround the first tube so that the outer passageway is an annular passageway that is in concentric relationship with the inner passageway.

The orifice may be a nozzle. The nozzle may include a nozzle member with a tapered portion, connected to the second tube, that is positioned a certain distance relative to an end of the first tube. The tapered portion and the tube end therefore form the orifice, with the orifice having an annular throat region for communicating the airflow from the outer to the inner passageway. The size of the throat region determines the airflow rate in the inner passageway. This can be adjusted by changing the position of the end of the first tube relative to the nozzle member tapered portion.

The end of the first tube may include a portion that is inwardly tapered leading into the inner passageway. Such tapered portion cooperates with the tapered portion of the nozzle member to form the orifice so that the orifice is shaped in a substantially annular taper. This is an advantage in that it permits the orifice or nozzle to accelerate the airflow from the outer into the inner passageway in a smooth and non-turbulent manner. This is important because the airflow is thereby introduced into the inner passageway so that the airflow flows through such passageway in parallel streamlines. This permits the airflow to cause tension in the thread without putting an undesirable twist in the thread.

Both cylindrical tubes may be connected to a manifold member. In such case, one end of the second tube is connected to the orifice or nozzle member, and the other end is connected to the manifold member. The manifold member includes a threaded bore through which the first tube extends. The first tube includes a threaded portion that engages with the threads of the bore. Rotation of the first tube relative to the manifold thereby causes the first tube to translate relative to the second tube. This provides a means for changing the position of the end of the first tube relative to the tapered nozzle member for the purpose of easily adjusting the size of the annular orifice throat region. The manifold may also include an airflow passageway for connecting an air supply means to the outer passageway.

The airflow in the inner passageway issues from the other end of the first tube into a region through which the thread extends and travels before the thread is fed into the inner passageway. An air deflector is positioned in such region in a manner so as to direct the airflow against the thread to control thread slack. Such region may be formed from a channeling member that has a portion or member that supports the air deflector. Such channeling member includes walls that define channels for directing the airflow against the thread. Another portion of the channeling member includes a means for preventing an increase in the amount of thread slack that may result from the deflected airflow pulling thread from the spool when the thread is not moving through the region. Such means may guide the thread from the spool into the region, with such guiding means having a portion that includes a surface that is covered with an abrasive material, such as sandpaper, for example. The covered surface is positioned so that the thread contacts the covered surface only when the thread is in a slack condition in the region.

An advantage of the present invention is that it provides a pneumatic tensioning device that has the capability of maintaining a substantially uniform tension in a thread as the thread is fed from a spool to a knitting or fabric weaving machine. Uniform feed tension is important for achieving a uniformly knit or woven fabric. This becomes especially important in fabrics having a plurality of colors and patterns, and wherein the fabric is to be cut into sections and combined to make a garment. In such case, it is important that the colors and patterns match between the various sections. to achieve such match with a minimization of waste the knit should therefore be as uniform as possible. In association with this, many modern day knitting machines are computerized and operate automatically to change the knitting field width of the machine. The instant invention can maintain uniform thread tension even though the field width changes during a particular knitting process.

Another advantage of the present invention is that it provides a pneumatic tensioning device wherein thread feed tension may be easily and simply adjusted.

Another advantage of the present invention is that it provides a pneumatic tensioning device that requires minimum maintenance. A certain amount of particulate matter or lint is shed from thread as it is fed from the spool to the knitting or fabric weaving machine. This is especially true for threads made of yarn. In the instant device most of such matter is discharged from the device by the airflow in the inner tube, thereby minimizing particulate matter accumulation or buildup in the device itself. Any buildup that may occur, however, may be easily removed because of the simplified and efficient construction of the device.

Another advantage of the present invention is that it provides a pneumatic device that is quiet and utilizes a minimum amount of energy to maintain uniform thread feed tension.

Another advantage of the present invention is that it eliminates the need to use tensioning rings on thread that is fed between a spool and a knitting machine. Many tensioning devices currently in use require tensioning rings between the spool and the device. Such rings typically must be adjusted by hand and are prone to getting out of adjustment due to lint and particulate matter that accumulates on the rings from the thread.

Still another advantage of the present invention is that it provides a pneumatic tensioning device that is adaptable for use on a wide variety of knitting and fabric weaving machines.

These and other advantages of the present invention will become more apparent upon reading the description of the invention which follows.

BRIEF DESCRIPTION OF THE DRAWINGS

Referring now to the drawings, like reference numbers and letters refer to like parts throughout the various views, and wherein.

BEST MODE FOR CARRYING OUT THE INVENTION

Figure 1:
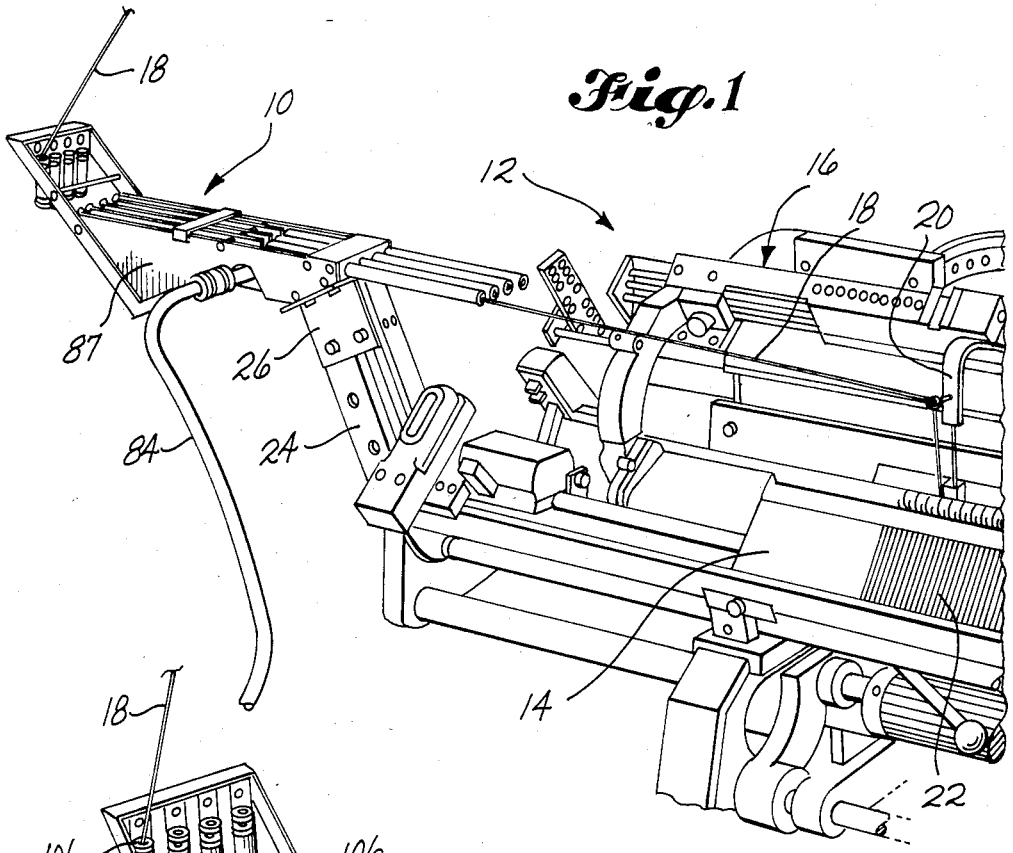
FIG. 1 is a pictorial view showing a pneumatic air tensioning device constructed in accordance with a preferred embodiment of the present invention, wherein the device is mounted to the end of a knitting machine and is feeding a thread of yarn from a spool (not shown in the drawings) to a knitting machine.

Referring now to FIG. 1 of the drawings, therein is shown a pneumatic air tensioning device 10 constructed in accordance with a preferred embodiment of the present invention. For the purpose of providing an illustrative example of the working environment in which the device 10 may be used, the device 10 is shown in FIG. 1 mounted to an end of a yarn knitting machine 12. The knitting machine 12 may include, for example, a needle bed 14, and a carrier 16. The carrier 16 reciprocates back and forth across the needle bed 14, and a feeder portion 20 of the carrier feeds a thread of yarn 18, or the like, to a plurality of knitting needles 22 located on the needle bed.

The thread 18 is fed from a spool (not shown in the drawings) through the tensioning device 10 and onward to the knitting machine 12. The device 10 maintains a certain amount of tension in the thread 18 as the carrier 16 moves back and forth across the needle bed 14. The device 10 is mounted to the knitting machine 12 by means of a supporting frame 24 connected to the end of the machine. The device 10 may be suitably connected to the frame 24 by bolting it to flanges 26 that are also connected by bolts to the frame.

The general construction of the knitting machine 12 as described above would be well-known to a person skilled in the art. It should be appreciated that the device 10 could be mounted to a variety of similar knitting or fabric weaving machines. By way of example only, one such machine for which the device 10 is particularly well suited is a flat bed knitting machine manufactured by Dubied, a Swiss corporation located in Couvet, Switzerland. Such machine is commonly known as the Dubied (registered trademark) Jet 2 Knitting Machine, and can be identified by Dubied Serial No. 194428.

The tensioning device 10 may include a plurality of thread feed tubes 28, 30, 32, 34 for maintaining tension in a plurality of threads as they are fed to the knitting machine 12. The construction and operation of each tube is the same. Therefore, for the purpose of simplifying the present description, only the construction and operation of one feed tube, designated by numeral 28, will be described herein.

Figures 3, 4, 5, 6, 7, 8:
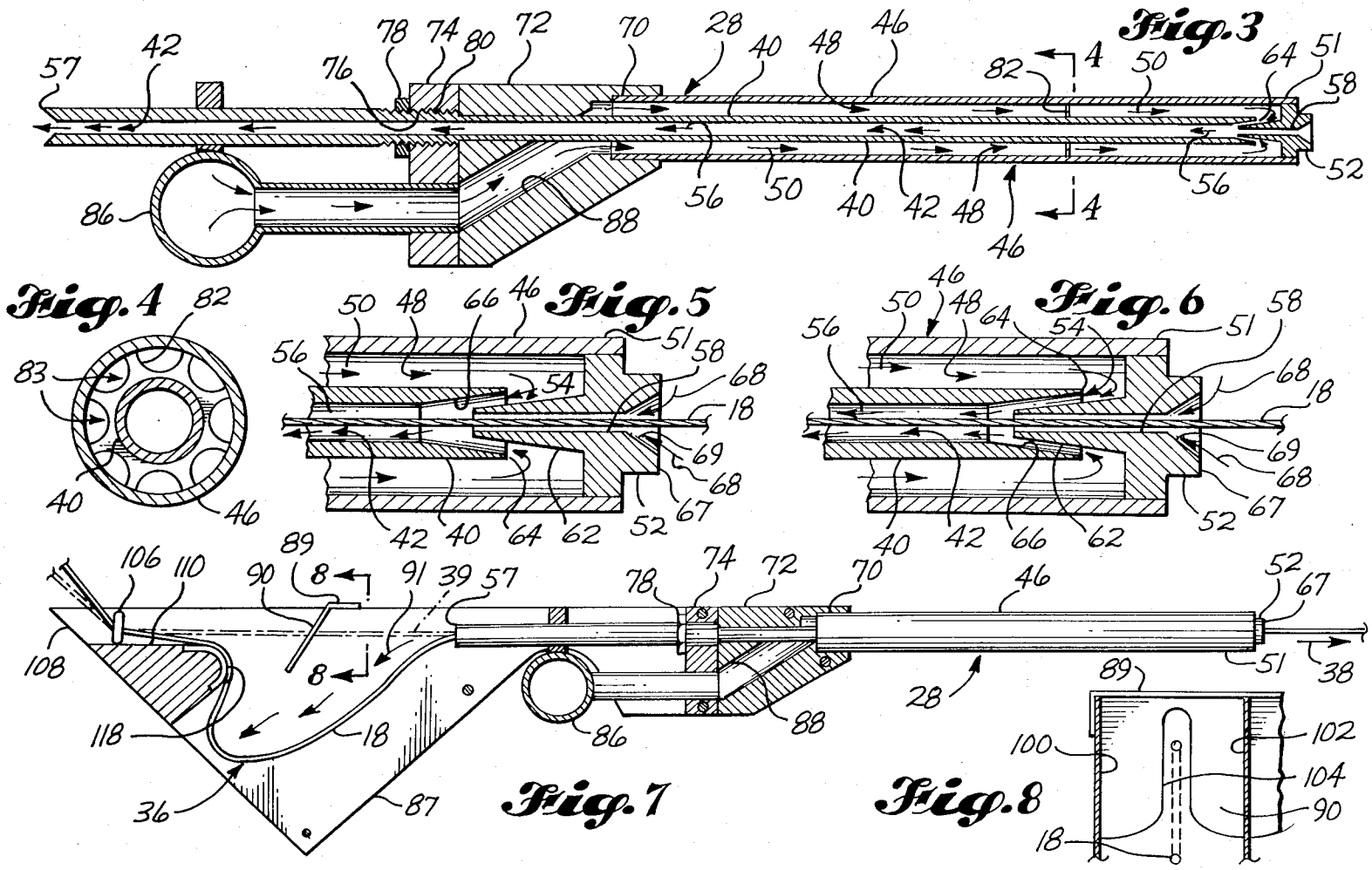
FIG. 3 is a side cross sectional view of one of the thread feed tubes comprising the forward or right end of the device shown in FIGS. 1 and 2.
FIG. 4 is a sectional view taken along line 4—4 in FIG. 3.
FIG. 5 is an enlarged fragmentary sectional view of the right end of the thread feed tube shown in FIG. 3.
FIG. 6 is a view like FIG. 5, but shows a change in position of a tapered nozzle member relative to the end of a cylindrical tube.
FIG. 7 is a side elevation, in partial section, of the device shown in FIGS. 1 and 2, wherein the view is taken along line 7—7 in FIG. 12.
FIG. 8 is an enlarged fragmentary sectional view taken along line 8—8 of FIG. 7, and shows an air deflector for controlling thread slack.

Referring now to FIG. 7, the thread 18 is first fed from the spool into a thread slack control region or portion of the device 10, which is indicated generally by arrow 36. The thread 18 extends and travels through the region 36 and is then fed into the thread feed tube 28. Travel of the thread through the feed tube 28 is influenced by the stroke of the machine carrier 16. When the carrier 16 moves from left to right (forward stroke), the thread 18 is pulled through the feed tube in the direction indicated by arrow 38 and little or no slack will exist in the thread. For example, the thread 18 would be extending and moving through the region 36 in the non-slack condition indicated by the dashed line 39. Airflow in the feed tube 28, which will be described and explained later, causes the thread 18 to be kept in substantially constant tension as it travels out of the feed tube 28 and onward to the knitting needles 22.

During the backstroke of the carrier 16, i.e., as the carrier moves from right to left, a smaller amount of thread 18 is pulled from the spool. This is because a certain amount of thread to feed the needles 22 during the backstroke was already pulled from the spool during the forward stroke. In such situation, the carrier 16 is moving toward the device 10, and airflow in the feed tube 28 maintains thread tension and will take up any slack that results from such movement. Any thread slack resulting from the backstroke is transferred into the region 36. There, it is further controlled by the feed tube airflow, which will be explained alter.

To summarize, the device 10 maintains tension in the thread at all times as it is fed to the knitting needles 22. Thread tension may vary a small amount when comparing tension during the carrier forward stroke with tension during the backstroke. This results from the carrier 16 moving away from the device 10 during the forward stroke, and toward the device during the backstroke. But the tension will be substantially uniform and the same for every forward stroke, and likewise, tension will be substantially uniform and the same for every backstroke. Any variation which occurs between forward and backstrokes will be relatively minor.

Referring now to FIG. 3, the construction and operation of the feed tube 28 will now be described. The feed tube 28 includes a first or inner cylindrical tubular member 40 that defines an inner airflow passageway (indicated generally by arrow 42). The thread 18, which is not shown in FIG. 3, extends and travels through the inner passageway 42. Surrounding the first tube 40 is a second or outer cylindrical tubular member 46. The inner walls of the outer tube 46 and the outer walls of the inner tube 40 define an outer passageway that is indicated generally by arrow 48. In preferred form, the outer passageway 48 is coaxial and concentric with the inner passageway 42.

An airflow is directed through the outer passageway 48 in the direction indicated by arrows 50. A nozzle member 52, connected to the right end 51 of the outer tube 46, is provided for communicating the airflow from the outer passageway 48 into the inner passageway 42. A tapered portion 62 of the nozzle member 52 and the right end 64 of the inner tube 40 defines an orifice 54 (see FIGS. 5 and 6). The orifice 54 reverses the airflow into the inner passageway 42 in the direction indicated by arrows 56.

Thus, the thread 18 is fed from the region 36 into the left end 57 of the inner tube 40, and then into the inner passageway 42. The thread exits the inner passageway 42 through a bore 58 in the nozzle member 52. The direction of the airflow (see arrows 56) in the inner passageway 42 causes a certain amount of pulling force on the thread 18 in a direction that is at all times pulling away from the carrier 16. Therefore, a certain amount of tension is maintained in the thread as it is fed to the needles 22 during both the forward and backstroke of the carrier 16.

The amount of tension is the thread 18 during the forward and backstrokes may be adjusted by adjusting the amount of airflow in the inner passageway 42. The orifice 54 has a throat region of a certain size for permitting the passage of air between the outer and inner passageways 48, 42. The throat region is, of course, formed by the tapered portion 62 of the nozzle member 52, and the tube end 64. By adjusting the position of the tapered portion 62 relative to the tube end 64, the size of the orifice throat region 54 may be adjusted, which further adjusts the amount of airflow between the outer and inner passageways 48, 42. Such adjustment may be accomplished by translating the position of the inner tube 40 relative to the outer tube 46, which is illustrated in FIGS. 5 and 6. In FIG. 6, the position of the tapered portion 62 is farther away from the tube end 64 than the position shown in FIG. 5. Therefore, the position shown in FIG. 6 would permit a greater airflow into the inner passageway 42. The means for translating or adjusting the position of the outer tube 46 relative to the inner tube 40 will be described later herein. It would be apparent to the reader that when the tapered portion 62 abuts the tube end 64, the orifice throat region 54 closes and no airflow communication is permitted between the outer and inner passageways 48, 42. A slight displacement of the tapered portion 62 from the tube end 64 therefore permits airflow.

In preferred form, the right end 64 of the inner tube 40 will have a portion 66 that is inwardly tapered. The tapered portion 66 may be shaped for fitment to the tapered portion 62 of the nozzle 52. Such fitment would cause the orifice throat region 54 to be in a substantially annular but tapered form as is shown in FIGS. 5 and 6. This is an important feature between the tapered annular shape of the orifice 54 causes a uniform acceleration of airflow between the two passageways. The airflow introduced into the inner passageway 42 is therefore an airflow having streamlines that are uniform and parallel. This means that the airflow in the inner passageway 42 will not place twist on the thread 18 as the thread extends and travels through the feed tube 28. It should be appreciated that because of a free stream vacuuming effect, a certain amount of ambient air (indicated generally by arrow 68) is introduced into the inner passageway 42 through the nozzle member bore 58. The outer end 67 of the nozzle member 52 may include a symmetric inwardly tapered portion 69. This permits ambient air introduced through the bore 58 to likewise flow uniformly in parallel streamlines into the inner passageway 42 without placing twist on the thread 18. Such uniform flow results in the thread 18 being pulled through the inner passageway 42 without contacting the inner walls of the inner tube 40.

In a preferred embodiment, the other or left end 70 of the outer tube 46 is connected to a manifold member or block 72. Attached to the rear of the manifold block 72 is a manifold plate 74. The manifold plate 74 may be attached to the manifold block 72 by set screws or any other suitable means.

The manifold plate 74 includes a threaded bore 76. The inner tube 40 extends through the bore 76 and terminates at its other or left end 57 in the region 36 (see FIG. 7). A section 80 of the inner tube 40 that is adjacent the threaded bore 76 also has threads. The threads of section 80 engage with the threads of the bore 76 so that when the inner tube 40 is rotated relative to the manifold block 72, the inner tube translates relative to the outer tube 46. This provides an easy means for adjusting the position of the tube end 64 relative to the nozzle tapered portion 62 in the manner shown and described in FIGS. 5 and 6. A nut 78 may be threaded onto the threaded portion 80 of the inner tube 40, and tightened against the manifold plate 74 to keep the inner tube 40 in the same position relative to the outer tube 46 once a desired airflow adjustment has been made.

It is desirable to maintain a concentric relationship between the outer and inner passageways 48, 42 so that the orifice throat region 54 will maintain a substantially annular shape at all times. Therefore, an annular spacer 82 (see FIG. 4) is provided in the outer passageway 48 between the inner and outer tubes 40, 46 for the purpose of ensuring such concentric relationship. The spacer 82 is provided with suitable openings 83 so that the spacer does not appreciably impede airflow in the outer passageway 48.

Figure 2:
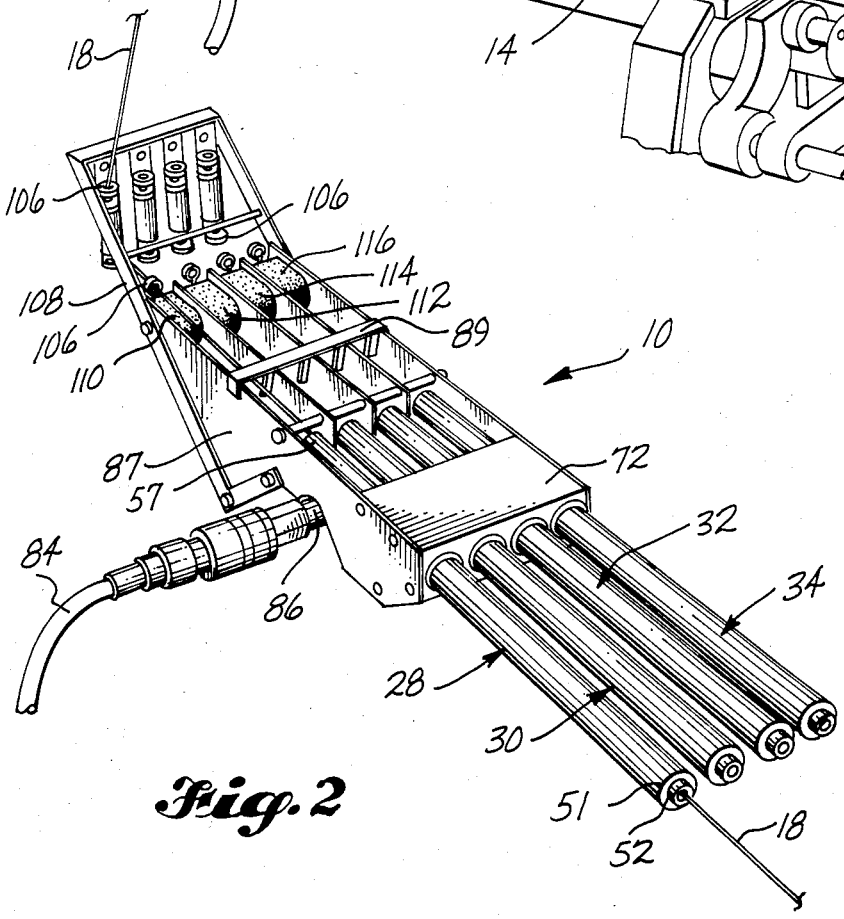
FIG. 2 is an enlarged pictorial view of the device shown in FIG. 1.

The outer passageway 48 may be supplied with an airflow from a pressurized source of air, such as an air pressure hose 84 shown in FIGS. 1 and 2. Air may be delivered from the air hose 84 into an air distribution chamber 86. A passageway 88 in the manifold block 72 connects the air distribution chamber 86 to the outer passageway 48. The air supplied by the air pressure hose 84 may be of a fairly low pressure. For example, a pressure of 1.0 psig may be sufficient, which would result in a pressure of 0.25 psig in the outer passageway of each feed tube 28, 30, 32, 34. What this means is that the invention requires very little energy to maintain thread tension.

Preferably, the length of the inner passageway 42 defined by the tube 40 will be optimally determined by the inner diameter of the passageway and the rate of airflow therein. It is desirable to have a sufficient tube length so that the airflow can pull on the thread 18 for as long of a time as is possible. This in turn reduces the amount of airflow required to maintain a desired tension in the thread. If the tube 40 is too long, or if the inner diameter of the passageway 42 is too small, a back pressure may be developed in the tube requiring additional energy to drive the airflow through the tube. Therefore, tube length and inner diameter should be sized accordingly.

The airflow exiting the tube end 57 enters the slack control region 36. The region 36 may be formed by a channeling member 87. The channeling member 87 includes a support member 89, connected to the top of the channeling deflector 90 directs the airflow against the thread the airflow issues from tube end 57 in the manner indicated by arrows 91. Such air deflection controls the transfer of thread slack to the region 36 during the back stroke of the carrier 16.

Figures 9, 10, 11, 12:
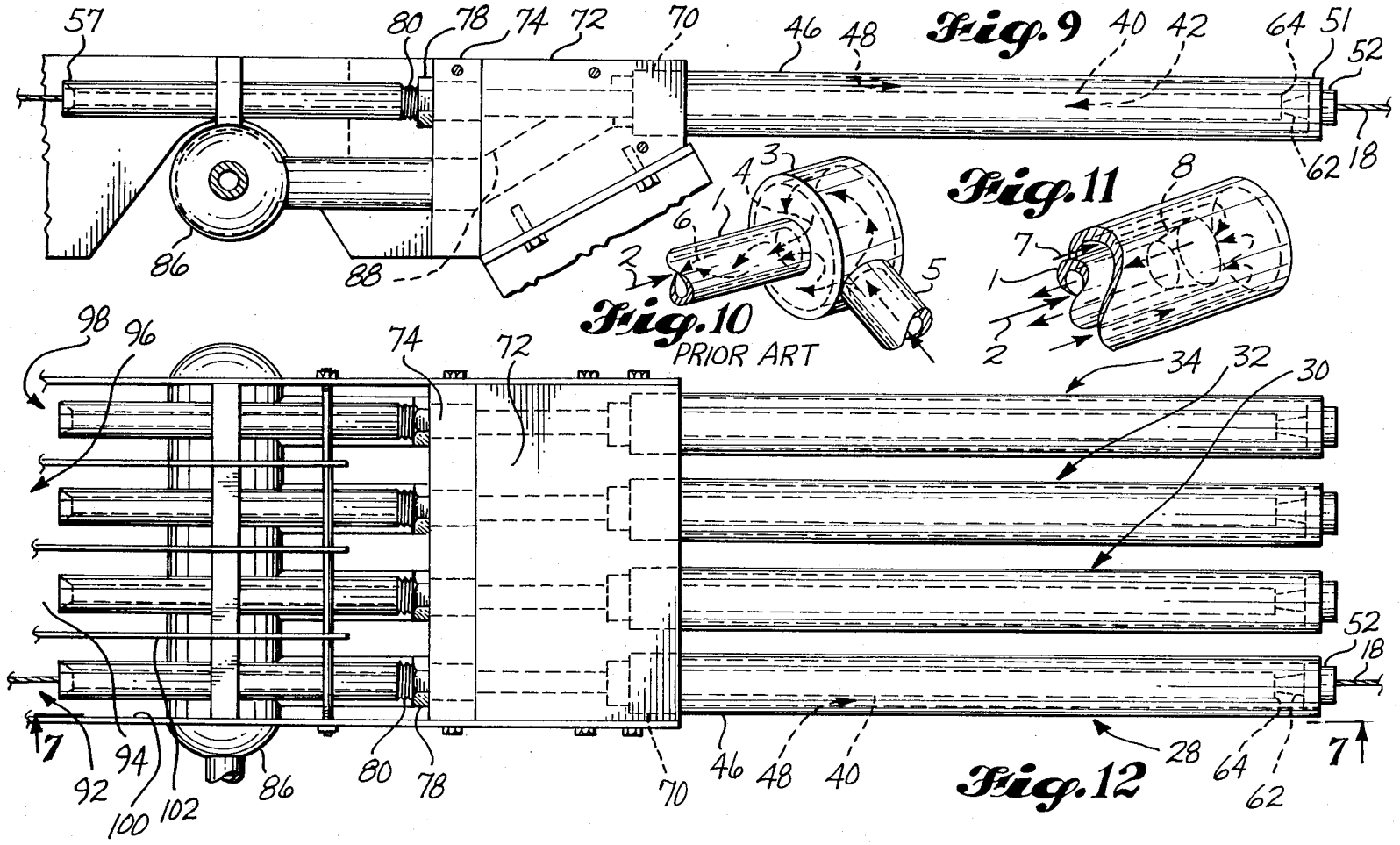
Fig. 10 PRIOR ART
FIG. 9 is an enlarged fragmentary side elevation of the forward or right end of the device shown in FIGS. 1 and 2.
FIG. 10 is a schematic pictorial representation of the method by which prior art devices utilize an airflow in a passageway to control thread feed tension.
FIG. 11 is a schematic pictorial view showing at least one of the differences between the present invention and the prior art.
FIG. 12 is an enlarged fragmentary top plan view of the forward or right end portion of the device shown in FIGS. 1 and 2.

The channeling member 87 includes a separate channeling region, indicated generally by arrows 92, 94, 96, and 98 in FIGS. 2 and 10, for each respective thread feed tube 28, 30, 32, 34. By way of example only, and referring now to channeling region 92 in FIG. 12, each region may be constructed of first and second walls 100 and 102 which define an airflow channel through which air is directed from the end 57 of the inner tube 40. A separate air deflector 90 would be positioned in each channeling region 92, 94, 96, 98 (see FIG. 8), between the walls 100, 102 of each region. Each deflector 90 is provided with a slot 104 that permits the thread 18 to tighten and slacken freely in the region 36 in response to movement of the carrier 16 without contacting the channeling region walls 100, 102 or the air deflector 90.

The thread 18 may be fed from the spool through thread eyelets 106 that are mounted on an aft portion 108 of the channeling member 87. Such aft portion 108 may also include guiding portions 110, 112, 114, 116 for each respective channeling region 92, 94, 96, and 98. Referring now to the guiding portion 110 shown in FIG. 7, each guiding portion is provided with a surface 118 that is covered with an abrasive material such as sandpaper, for example. The abrasive material 118 is positioned on the surface of the guiding portion 110 so that the thread 18 contacts the material when the thread is in a slack and nonmoving condition. Therefore, as the carrier 16 of the knitting machine reciprocates back and forth, the thread 18 will not contact the material during the forward stroke of the carrier as the thread is pulled through the feed tube 28. When the direction of the carrier 16 is reversed, however, the transfer of thread slack into the region 36 will cause the thread to contact the surface 118. Such contact holds the thread and prevents the force of the airflow 91 issuing from the tube end 57 from pulling more thread from the spool during the carrier back stroke.

The thread eyelet 106, positioned adjacent the guiding portion 110 is located so that during the carrier forward stroke the thread is fed directly into the end 57 of the feed tube 28 without contacting the edges of the tube end. Since the airflow in the inner passageway 42 is smooth and nonturbulent, contact of the thread with the inner walls of the inner tube 40 is minimized at all times as the thread is fed to the knitting machine.

Particulate matter or lint shed from the thread is blown out through the end 57 of the inner passageway 42. The aft portion (not shown on the drawings) of each channeling region 92, 94, 96, 98 is open. The deflected airflow 91 thus exits through the aft portion of each channeling region and particulate matter or lint may also be blown therethrough. This results in a minimal amount of particulate matter accumulation or buildup in the device itself.

While an exemplary embodiment of the present invention has been described above and shown in the accompanying drawings, it is to be understood that such embodiment is merely for illustrative purposes only. Obviously, certain cchanges may be made to the invention without departing from the spirit and scope thereof. For example, it may be possible to introduce a smooth and nonturbulent airflow into the inner passageway 42 without reversing the airflow in the manner shown and described in FIGS. 3–6. It is therefore conceivable that an outer annular passageway could be extended forwardly of the end 52 of the thread feed tube 28. In this case, an airflow that is traveling in a parallel but opposite direction to the thread could be introduced into the inner passageway 42 by means of the orifice 54 without a reversal of airflow direction between the two passageways. Such a construction would be undesirable, however, because it would needlessly extend the length of the device 10 as shown in the drawings. It is intended that the scope of the invention shall be limited only by interpreting the appended claims which follow, in accordance with the well-established doctrines of patent claim interpretation.

What is claimed is:

1. A pneumatic tensioning apparatus for maintaining a desired tension in a thread of yarn and the like, the apparatus comprising:

a first tubular member having an inner passageway extending the length thereof along an axis, and through which said thread may travel in a particular thread feed direction;

a second tubular member surrounding said first member so that the inner walls of said second member and the outer walls of said first member define an outer passageway that is coaxial with said axis;

an air supply means for supplying an airflow into said outer passageway in a direction that is substantially the same as said feed direction;

an orifice including a substantially annular throat region for communicating said airflow from said outer passageway into said inner passageway, said orifice connecting said passageways together in a manner so that the direction of said airflow is reversed and said airflow flows through said inner passageway in a direction opposite to said feed direction, such opposing flow causing a certain amount of tension in said thread; and including means for adjusting the airflow rate through said orifice throat region by varying the size of said throat region.

2. The apparatus of claim 1, wherein said orifice is generally in the form of a conically-shaped passageway connecting said outer passageway to said inner passageway.

3. The apparatus of claim 1, wherein said first and second members each comprise cylindrical tubes, and with said outer passageway being an annular passageway in concentric relationship with said inner passageway, and wherein said orifice comprises a nozzle member and an end of said first tube, said nozzle member being connected to said second tube and having a tapered portion, with said tapered portion and said end defining said throat region, the size of said region being variable according to the position of said end relative to said tapered portion, and said adjusting means comprises means for translating said first tube relative to said second tube, to adjust the size of said throat region by changing the position of said end relative to said tapered portion.

4. The apparatus of claim 3, wherein said end of said first tube includes a portion that is inwardly tapered leading into said inner passageway.

5. The apparatus of claim 4, wherein said tapered portion of said end of said first tube is shaped for fitment to said tapered portion of said nozzle member when said position of said second tube relative to said first tube is adjusted so as to close said throat region.

6. The apparatus of claim 4, wherein each of said first and second cylindrical tubes are connected to a manifold member, and wherein said nozzle member is connected to an end of said second tube, with said second tube being fixedly connected to said manifold member, and further, said adjusting means comprises a threaded bore in said manifold member and through which said first tube extends, said first tube including a threaded portion that engages with the threads of said bore so that rotation of said first tube relative to said manifold member causes said first tube to translate relative to said second tube, such translation changing the position of said end of said first tube relative to said nozzle member tapered portion, to variably adjust the size of said annular throat region.

7. The apparatus of claim 6, wherein said manifold includes an airflow passageway connecting said air supply means to said outer passageway.

8. In a pneumatic tensioning apparatus that maintains a desired tension in a thread of yarn and the like as said thread is fed from a spool to a knitting or fabric weaving machine, wherein said thread is first fed into and extends through a region, and is then fed into a passageway, an apparatus for controlling thread slack in said region, the apparatus comprising:

means for providing an airflow in said passageway, wherein said airflow issues from said passageway in a direction that opposes the feed direction of said thread travel into said passageway, an air deflector positioned in said region in a manner so as to direct said airflow against said thread after said airflow issues from said passageway, to control slack in said thread as it extends through and travels across said region, and including an air channeling member having a first portion that supports said air deflector, and having wall means for defining said region, said wall means further directing said air stream to control thread slack, and wherein said channeling member includes a second portion having a means for preventing an increase in the amount of thread slack in said region when said thread is not being fed into said passageway.

9. The apparatus of claim 8, wherein said second portion includes a guiding means for guiding said thread into said region, said slack preventing means including a portion of said guiding means that has a surface covered with an abrasive material, wherein said covered surface is positioned so that said thread contacts said material only when said thread in said region is in a slack condition.

10. The apparatus of claim 9, wherein said wall means includes a first wall and a second wall, with said first and second walls being positioned relative to each other so that an airflow channel region is formed between them, and wherein said walls are positioned relative to said passageway so that the airflow issuing therefrom is directed into said channel region.

11. The apparatus of claim 10, wherein said air deflector is positioned between said first and second walls.

12. A pneumatic tensioning apparatus for maintaining a desired tension in a thread of yarn and the like as said thread is fed from a spool or the like to a knitting or fabric weaving machine, the apparatus comprising:

a first elongated tubular member having an inner passageway extending the length thereof along an axis, and through which said thread may travel in a particular thread feed direction;

a second elongated tubular member surrounding said first member so that the inner walls of said second member and the outer walls of said first member define an outer passageway that is coaxial with said axis;

an air supply means for supplying an airflow into said outer passageway in a direction that is substantially the same as said thread feed direction;

an orifice for communicating the airflow from said outer passageway into said inner passageway in a manner so that the direction of said airflow is reversed and said airflow flows through said inner passageway in a direction opposite to said feed direction, such opposing flow causing a certain amount of tension in said thread, wherein said reversed airflow travels the length of said inner passageway and issues from an end thereof, and wherein said thread is fed into and extends through a region, and then is fed into said end; and an air deflector positioned in said region in a manner so as to direct said airflow against said thread after said airflow issues from said end of said passageway, to control slack in said thread as it extends through and travels across said region.

13. The apparatus of claim 12, wherein said orifice is generally in the form of a conically-shaped passageway connecting said outer passageway to said inner passageway.

14. The apparatus of claim 12, wherein said orifice includes a substantially annular throat region for communicating said airflow between said outer and inner passageways, with said annular throat region accelerating said airflow from said outer passageway into said inner passageway.

15. The apparatus of claim 14, including means for adjusting the airflow rate through said orifice throat region.

16. The apparatus of claim 15, wherein said first and second members each comprise elongated cylindrical tubes, and with said outer passageway being an annular passageway in concentric relationship with said inner passageway, and wherein said orifice comprises a nozzle member and an end of said first tube, said nozzle member being connected to said second tube and having a tapered portion, with said tapered portion and said tube end defining said throat region, the size of said region being variable according to the position of said tube end relative to said tapered portion, and said adjusting means comprises means for translating said first tube relative to said second tube, to adjust the size of said throat region by changing the position of said tube end relative to said tapered portion.

17. The apparatus of claim 16, wherein said end of said first tube includes a portion that is inwardly tapered leading into said inner passageway.

18. The apparatus of claim 17, wherein said tapered portion of said end of said first tube is shaped for fitment to said tapered portion of said nozzle member when said position of said second tube relative to said first tube is adjusted so as to close said throat region.

19. The apparatus of claim 17, wherein each of said first and second cylindrical tubes are connected to a manifold member, and wherein said nozzle member is connected to an end of said second tube, with said second tube being fixedly connected to said manifold member, and further, said adjusting means comprises a threaded bore in said manifold member and through which said first tube extends, said first tube including a threaded portion that engages with the threads of said bore so that rotation of said first tube relative to said manifold member causes said first tube to translate relative to said second tube, such translation changing the position of said end of said first tube relative to said nozzle member tapered portion, to variably adjust the size of said annular throat region for adjusting the airflow rate therethrough.

20. The apparatus of claim 19, wherein said manifold includes an airflow passageway connecting said air supply means to said outer passageway.

21. The apparatus of claim 20, including an air channeling member having a first portion that supports said air deflector, and having wall means for defining said region, said wall means directing said air stream to control thread slack.

22. The apparatus of claim 21, wherein said channeling member includes a second portion having a means for preventing an increase in the amount of thread slack which may result from said directed airflow pulling thread from said spool when said thread is not being fed into said passageway.

23. The apparatus of claim 22, wherein said second portion includes a guiding means for guiding said thread into said region, said slack preventing means including a portion of said guiding means that has a surface covered with an abrasive material, wherein said covered surface is positioned so that said thread contacts said material only when said thread in said region is in a slack condition.

24. The apparatus of claim 23, wherein said wall means includes a first wall and a second wall, with said first and second walls being positioned relative to each other so that an airflow channel region is formed between them, and wherein said walls are positioned relative to said passageway so that the airflow issuing therefrom is directed into said channel region.

25. The apparatus of claim 24, wherein said air deflector is positioned between said first and second walls.

26. In a pneumatic tensioning apparatus that maintains a desired tension in a thread of yarn and the like as said thread is fed from a spool to a knitting or fabric weaving machine, wherein said thread is first fed into and extends through a region, and is then fed into a passageway, and wherein a pressurized airflow is communicated into said passageway in a direction opposing the feed direction of said thread, and said airflow issues from said passageway into said region, an apparatus for controlling thread slack in said region, the apparatus comprising:

an air deflector positioned in said region in a manner so as to direct said airflow against said thread after said airflow issues from said passageway, to control slack in said thread as it extends through and travels across said region; and an air channeling member having a first portion that supports said air deflector, and having wall means for defining said region, said wall means directing said air stream to control thread slack, wherein said channeling member further includes a second portion having means for preventing an increase in the amount of thread slack in said region when said thread is not being fed into said passageway.

27. The apparatus of claim 26, wherein said second portion includes a guiding means for guiding said thread into said region, said slack preventing means including a portion of said guiding means that has a surface covered with an abrasive material, wherein said covered surface is positioned so that said thread contacts said material only when said thread in said region is in a slack condition.

28. The apparatus of claim 27, wherein said wall means includes a first wall and a second wall, with said first and second walls being positioned relative to each other so that an airflow channel region is formed between them, and wherein said walls are positioned relative to said passageway so that the airflow issuing therefrom is directed into said channel region.

29. The apparatus of claim 28, wherein said air deflector is positioned between said first and second walls.

* * * * *